US006283047B1

(12) United States Patent
Haller(-Hess)

(10) Patent No.: US 6,283,047 B1
(45) Date of Patent: Sep. 4, 2001

(54) HEIGHT-ADJUSTABLE TABLE OR THE LIKE

(75) Inventor: Heinrich Haller(-Hess), Flurlingen (CH)

(73) Assignee: Techinnovation GmbH, Flurlingen (CH)

( * ) Notice: Subject to any disclaimer, the term of this patent is extended or adjusted under 35 U.S.C. 154(b) by 0 days.

(21) Appl. No.: 09/600,276

(22) PCT Filed: Jan. 13, 1998

(86) PCT No.: PCT/CH98/00010

§ 371 Date: Jul. 13, 2000

§ 102(e) Date: Jul. 13, 2000

(87) PCT Pub. No.: WO99/35936

PCT Pub. Date: Jul. 22, 1999

(51) Int. Cl.[7] ..... A47B 9/00
(52) U.S. Cl. ..... 108/145; 108/147
(58) Field of Search ..... 108/2, 7, 144.11, 108/145, 146, 147, 10

(56) References Cited

U.S. PATENT DOCUMENTS

| | | | | |
|---|---|---|---|---|
| 3,080,835 | * | 3/1963 | Gugliemi | 108/147 |
| 3,710,735 | | 1/1973 | Litvinoff et al. . | |
| 5,313,892 | * | 5/1994 | Tice | 108/147 |
| 5,322,025 | * | 6/1994 | Sherman | 108/147 |
| 5,553,550 | * | 9/1996 | Doyle | 108/147 |

FOREIGN PATENT DOCUMENTS

| | | |
|---|---|---|
| 44 24 564 A1 | 1/1996 | (DE) . |
| 296 14 295 U1 | 11/1996 | (DE) . |
| WO 95/15097 | 6/1995 | (WO) . |

* cited by examiner

*Primary Examiner*—Peter M. Cuomo
*Assistant Examiner*—Jerry A. Anderson
(74) *Attorney, Agent, or Firm*—Cohen, Pontani, Lieberman & Pavane

(57) ABSTRACT

The height-adjustable table (22) comprises a base (1), a support (3) to hold a table top (21), a movable connecting element (2) which mounts the support (3) in a height-adjustable manner in relation to the base (1) and a pneumatic, pressure actuated weight counterbalancing element (7) which is fluidly connected to a reservoir (4) and is arranged between the base (1) and the support (3) in such a way that a reaction force is generated to counteract a gravitational force G acting on the support (3). The weight counterbalancing element (7) and the reservoir form a closed volume containing fluid.

13 Claims, 6 Drawing Sheets

HEIGHT-ADJUSTABLE TABLE OR THE LIKE

BACKGROUND OF THE INVENTION

1. Field of the Invention

The invention relates to a height-adjustable table or the like.

2. Descussion of the Prior Art

It is advisable, for considerations concerned with health and safety at work, for a person to avoid the same working postures for prolonged periods, which calls for work stations which enable different working postures to be adopted even during monotonous work. Particularly in the case of work stations predominantly involving a seated activity, such as, for example, video or CAD work stations, there is the risk, because of the working posture remaining the same for a long period, of excessive fatigue or even an occurrence of muscular-skeletal complaints.

WO 95/15097-A1 discloses a height-adjustable table which permits the table height to be adjusted using gas-filled compression springs. This table has the disadvantage that a height adjustment is only possible if there are no heavy loads on the table, and so this table is not suitable, for example, for a video or CAD work station in which the working equipment, in particular the video screens which are customarily relatively large and correspondingly heavy, stands on the table. A further disadvantage of the known height-adjustable table resides in the fact that even small changes in local necessitate changing the position of the gas-filled compression spring by means of a setting screw in order to compensate for the change in load so as then to be able to adjust the table height.

SUMMARY OF THE INVENTION

The object of the present invention is to provide a height-adjustable table or the like whose height can be adjusted in a simple manner even when the loads in effect are relatively large.

The invention is achieved, in particular, by means of a height-adjustable table comprising a base, a support for holding a tabletop, a moveable connecting means which supports the support in a height-adjustable manner with respect to the base, and also a pneumatic, pressure-actuable counterweight element which is connected in a fluid-conducting manner to a reservoir and is operatively arranged between the base and the support in such a manner that a reaction force can be generated acting counter to a gravitational force acting on the support. The counterweight element together with the reservoir form a closed volume containing a fluid.

The counterweight element and also the reservoir connected to it in a fluid-conducting manner form a closed volume, so that the amount of fluid enclosed in the closed volume is constant. A gas, in particular air, is suitable as the fluid. A cylinder having a displaceable piston, a balloon, a bellows cylinder, a U-type bellows cylinder, a tubular cylinder or a gas-filled compression spring is particularly suitable as the counterweight element. During a state hereby termed the normal state, the pressure of the air in the closed volume is adapted in such a manner to the gravitational force G acting on the support that a force is generated acting counter to the gravitational force G and the tabletop, together with all of the objects situated on it, is approximately in a position of equilibrium. For this purpose, a fluid has first of all to be supplied to the closed volume in order to compensate for the gravitational force G acting on the support and thereby to achieve the normal state. After that, the fluid is only supplied to or removed from the closed volume if the acting gravitational force G changes.

In order to avoid unintentionally adjusting the table height, a locking device is provided which fixes the position of the table at a designated working height.

One advantage of the height-adjustable table according to the invention resides in the fact that a height adjustment is possible manually and without external power. For this purpose, the locking device is released, the table height adjusted in a smooth-running manner and with negligibly little effort, and after that the locking device is again engaged. Since the table is in an at least approximate position of equilibrium, its height can be adjusted in a very smooth-running manner even with relatively heavy loads situated on the table.

In a preferred embodiment, the locking device permits an infinitely variable locking of the working height. In a further preferred embodiment, the locking device is arranged on the table surface or in the vicinity of the table surface in such a manner that the locking device can be operated and, at the same time, the height of the table can be adjusted using the same hand. Owing to the smooth-running height adjustment, the table can be brought very easily to the working height desired in each case, it being particularly convenient for the table height to directly follow the hand movement, which gives the person setting the height immediate feedback over the actual height, so that the person setting it can very conveniently and very rapidly establish which height is optimum for the particular requirements. In addition, it is possible, by means of a slight movement to and from around the preferred height range, to establish which height is felt to be the most convenient. A substantial advantage of the height-adjustable table according to the invention resides in the fact that the height adjustment takes place in a manner which is agreeable in every aspect for the person setting it, since a setting is possible which is rapid, can be set precisely, is smooth-running and is associated with a tactile or motor feedback. It is only thanks to this convenient operability that the person is motivated to undertake a height adjustment of the table more frequently, under some circumstances even several times daily, which is desirable for reasons concerned with ergonomics or health and safety at work. The previously known height-adjustable tables, for example driven by motor, do indeed permit a height adjustment, but this is generally felt to be so awkward or inconvenient that the height adjustability is only used rarely and not regularly.

The air pressure in the counterweight element and also in the reservoir can be set in such a manner that the tabletop, together with all of the objects situated on it, is approximately in a position of equilibrium. If additional, heavier objects are placed onto the tabletop, for example when a video screen is being replaced, air is pumped into the otherwise closed volume of the counterweight element and reservoir. For this purpose, use can be made, for example, of a separate compressed air container whose compressed air can be discharged via a valve of the reservoir in a meterable manner to the otherwise closed volume in such a manner that the table is again in a position of equilibrium. The compressed air could also, for example, be generated using a bicycle pump which can supply it directly to the otherwise closed volume via a valve. If the load resting on the table surface is reduced, the pressure in the otherwise closed volume can be reduced in such a manner that a position of equilibrium can again be produced, which is possible, for example, by virtue of the fact that an actuable valve permitting a controlled escape of air is arranged on the reservoir. One advantage of the height-adjustable table according to the invention resides in the fact that adaptation to a changed weight load to be supported by the table is possible in a simple manner without spring elements being replaced, without intervention by specialist staff and without the necessity of external power.

One advantage of the height-adjustable table according to the invention resides in the fact that a counterweight element can be produced with any desired flat spring characteristic, which has the result that the height adjustment of the tabletop from the lowest position to the uppermost position requires approximately the same small effort. The spring characteristic is all the flatter the larger the volume of the reservoir is selected to be. The volume is dimensioned in such a manner that the entire closed volume formed by the reservoir, the counterweight element and a connecting tube possibly arranged in between, is larger by a multiple than the volume required for a lifting movement of the counterweight element, or is larger by a multiple than the maximum volume which can be picked up by the counterweight element. The larger the entire volume, the flatter the spring characteristic. The major portion of the volume is preferably situated in the reservoir.

The height-adjustable table according to the invention can also be operated per se with a gas-filled compression spring, a correspondingly high gas pressure being required for this purpose in the reservoir, since so called gas-filled compression springs, as is known, have a gas-filled compression cylinder and a piston, the pressure-effective piston area of the gas-filled compression cylinder being relatively small. In order to generate a sufficiently large force in spite of this relatively small area, the gas in the gas-filled compression cylinder is at a relatively high pressure. In a preferred embodiment of the invention, use is made of a counterweight element which is based on the principle of a pneumatic cylinder and can be operated with a comparatively small pressure of at most 10 bar. Pneumatic cylinders of this type can also be referred to as air springs and can be used instead of the mechanical springs and gas-filled compression springs hitherto customary. In contrast to gas-filled compression springs, air springs of this type operate at comparatively small pressure. Air springs of this type can be installed in an unpressurized state. Charging with pressure takes place without any problem after the air spring has been installed into the height-adjustable table or even at the final installation location of the table and, moreover, without the necessity for a high-pressure pump. In the simplest case, a bicycle pump suffices. Air springs can also be adapted by simple pumping up or deflating, without specialist staff either, to the most varied loads without components having to be replaced.

The air spring can be designed as a conventional cylinder having a piston which can be displaced therein, or advantageously as a so called bellows cylinder, U-type bellows cylinder or tubular cylinder (also referred to as a "rolling lob spring" or "sleeve type spring" or "bellows type spring"). The latter have the advantage over conventional cylinders that they do not have any friction and are therefore also not subject to any wear. In addition, they operate without a dynamic seal, so that there is no risk of leakages. The latter are therefore particularly suitable for forming a closed volume which is gastight over the long term.

The moveable connecting means arranged between the base and the support of the tabletop can be designed as a parallelogram guide, as a linear guide or based on the scissors principle.

For reasons connected with safety regulations, damping of the lifting movement is required. The compensation forces brought about by the table are normally set to correspond to the weight forces acting on the table. Should the load be removed from the table for whatever reasons, and accordingly the locking device released, the tabletop would bounce up in an uncontrolled manner, which constitutes an acute risk of an accident. The height-adjustable table therefore has damping by the counterweight element being connected to the reservoir via a restrictor so as not to excessively stress designated limit stops of the height-adjustable table.

A further advantage of the height-adjustable table according to the invention resides in the fact that the mechanical components can be purchased or produced cost-effectively, so that the table according to the invention can be produced cost-effectively.

The device according to the invention for the. height adjustment is suitable for any type of furniture, working areas or working means. The exemplary embodiments illustrated in the following disclose a height-adjustable table underframe and a height-adjustable table having a tabletop. The height-adjustable frame according to the invention is suitable for any type of furniture, working areas or working means. Of Course, the tabletop could be designed so that it is inclined or inclinable, for example as in the case of a standing desk, or could consist of a plurality of subplates, some of which are mutually inclined, as is customary in the case of some CAD work stations.

BRIEF DESCRIPTION OF THE DRAWINGS

The invention is described in detail with reference to exemplary embodiments. In the drawings.

DETAILED DESCRIPTION OF THE PREFERRED EMBODIMENTS

Figure 6:
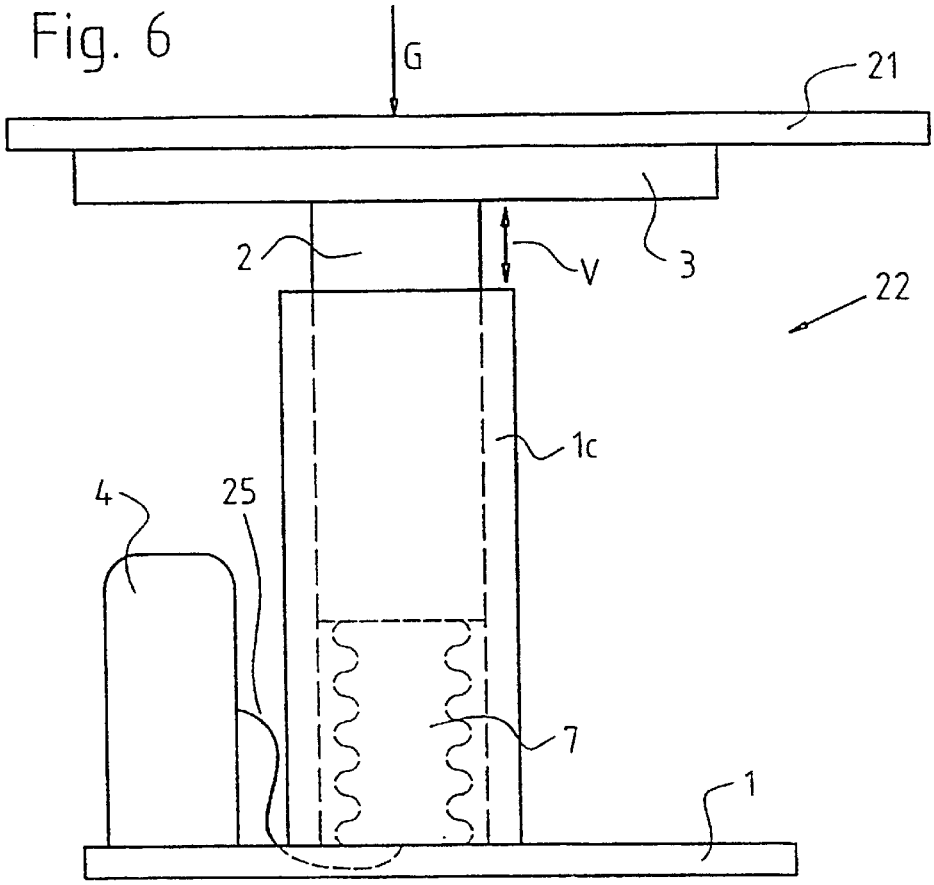
FIG. 6 shows, schematically, a further embodiment of a height-adjustable table.

FIG. 6 shows a height-adjustable table 22 having a base 1, a support 3 on which a tabletop 21 is. fastened, and also a connecting means 2 which can be moved linearly in the direction V and is guided telescopically in the hollow cylindrical part 1*c* of the base 1. Arranged within the hollow cylindrical part 1*c* is a counterweight element 7 which is designed as a bellows cylinder and generates on the connecting means 2 a force acting counter to the acting weight force G. The bellows cylinder 7 is connected to the reservoir 4 in a fluid-conducting manner via a flexible tube 25. The bellows cylinder 7, the flexible tube 25 and the reservoir 4 form a closed volume in which there is a constant amount of compressed air in the normal state illustrated. The volume of the reservoir 4 is a multiple of the change in volume to be expected in the bellows cylinder 7 because of the height adjustment so as to give the bellows cylinder 7 a flat spring characteristic. A valve which is situated on the reservoir 4 and through which air is blown into the reservoir 4 or let out of it, in order to produce a position of equilibrium of the table surface 21, is not illustrated. The locking device which allows the position of the table surface 21 to be fixed at a specified height is likewise not illustrated The height-adjustable table 22 according to FIG. 1*a* has two bases 1 which are arranged spaced apart in the longitudinal direction L of the tabletop 21 together with connecting means 2 and a support 3. The connecting means 2 is designed as a parallelogram linkage of levers and has two parallel articulated levers 2*a*, 2*b* which run at a distance one above the other and are coupled at one end to the base 1 and at the other end to the support 3 in a manner such that they can pivot around parallel articulated axles 5*a*, 5*b*, 5*c*, 5*d*. Each articulated lever 2*a*, 2*b* consists of two sub-levers 2*a*, 2*a*'; 2*b*, 2*b*' which are spaced apart in the longitudinal direction L, are of plane design and are mutually spaced apart in such a manner that there is space for the counterweight element 7, which is designed as a bellows cylinder, between the sub-levers 2*a*, 2*a*'; 2*b*, 2*b*'. This arrangement has the advantage that the bellows cylinder, which tends to collapse per se, is guided laterally by the sub-levers 2*a*, 2*a*'; 2*b*, 2*b*', so that the bellows cylinder can only extend in the designated direction, which is indicated by F, F' in FIG. 2. This lateral guidance therefore permits counterweight elements 7, which themselves do not have axial stability, to be used as a bellows cylinder. The base 1 and also the support 3 are also each designed in two parts and consist of two base parts 1*a*, 1*b* spaced apart in the longitudinal direction L and also of support parts 3*a*, 3*b*. The table 22 has two bases 1 which are spaced apart in the longitudinal direction L together with connecting means 2, a support 3 and a counterweight element. 7, the bases 1 being connected fixedly to one another via a common reservoir 4. The reservoir 4 advantageously serves to set the distance between the bases 1 and also to bring about stability. Both counterweight elements 7 have a fluid-conducting connection to the common reservoir 4.

Figure 1A:
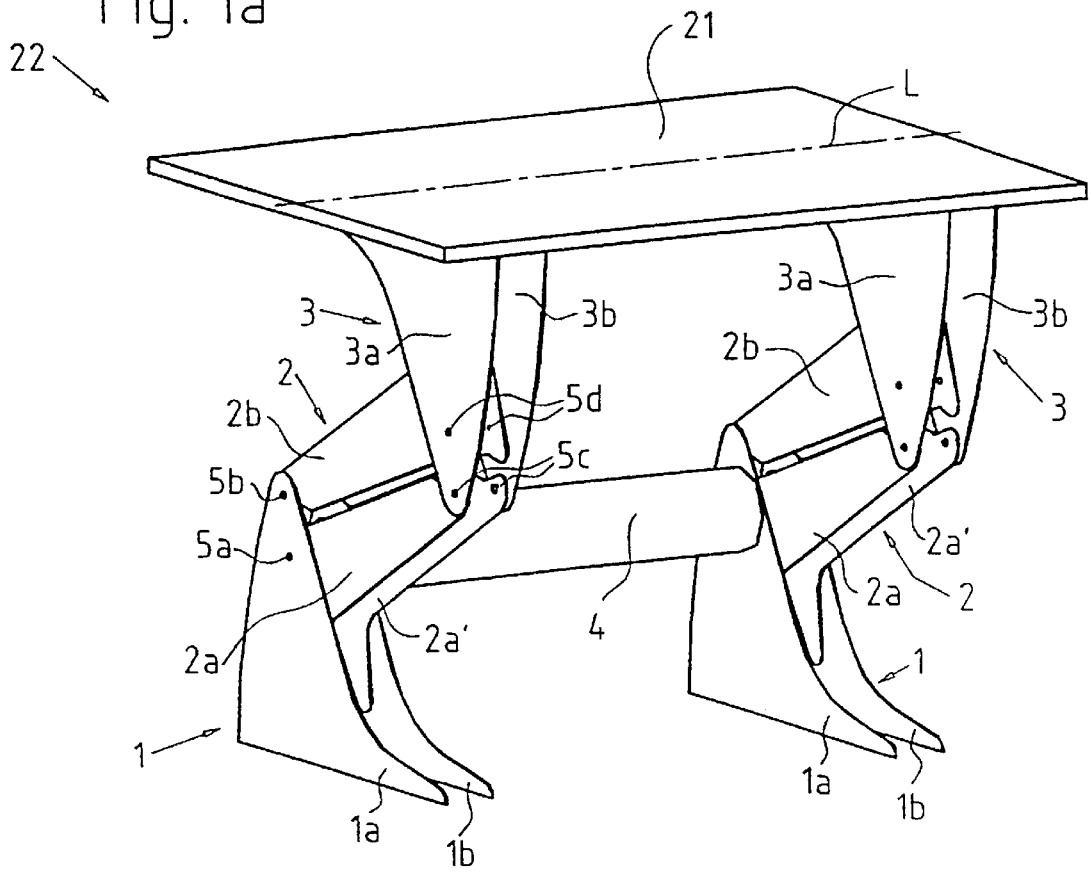
FIG. 1*a* shows a perspective illustration of a height-adjustable table of the present invention in a high position.
Figure 1B:
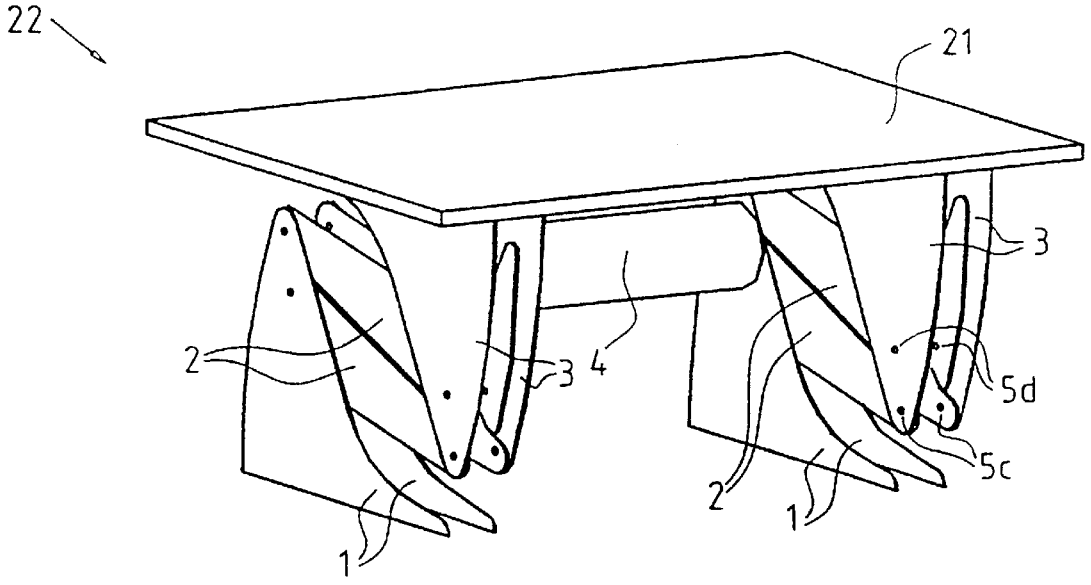
FIG. 1*b* shows the same table according to FIG. 1*a* in a low position.

FIG. 1*b* shows the same height-adjustable table 21 as in FIG. 1*a* in a low position, in which it can be seen that the articulated levers 2*a*, 2*b* are mounted such that they can pivot around the articulated axles 5*a*, 5*b*, 5*c*, 5*d*.

Figure 2:
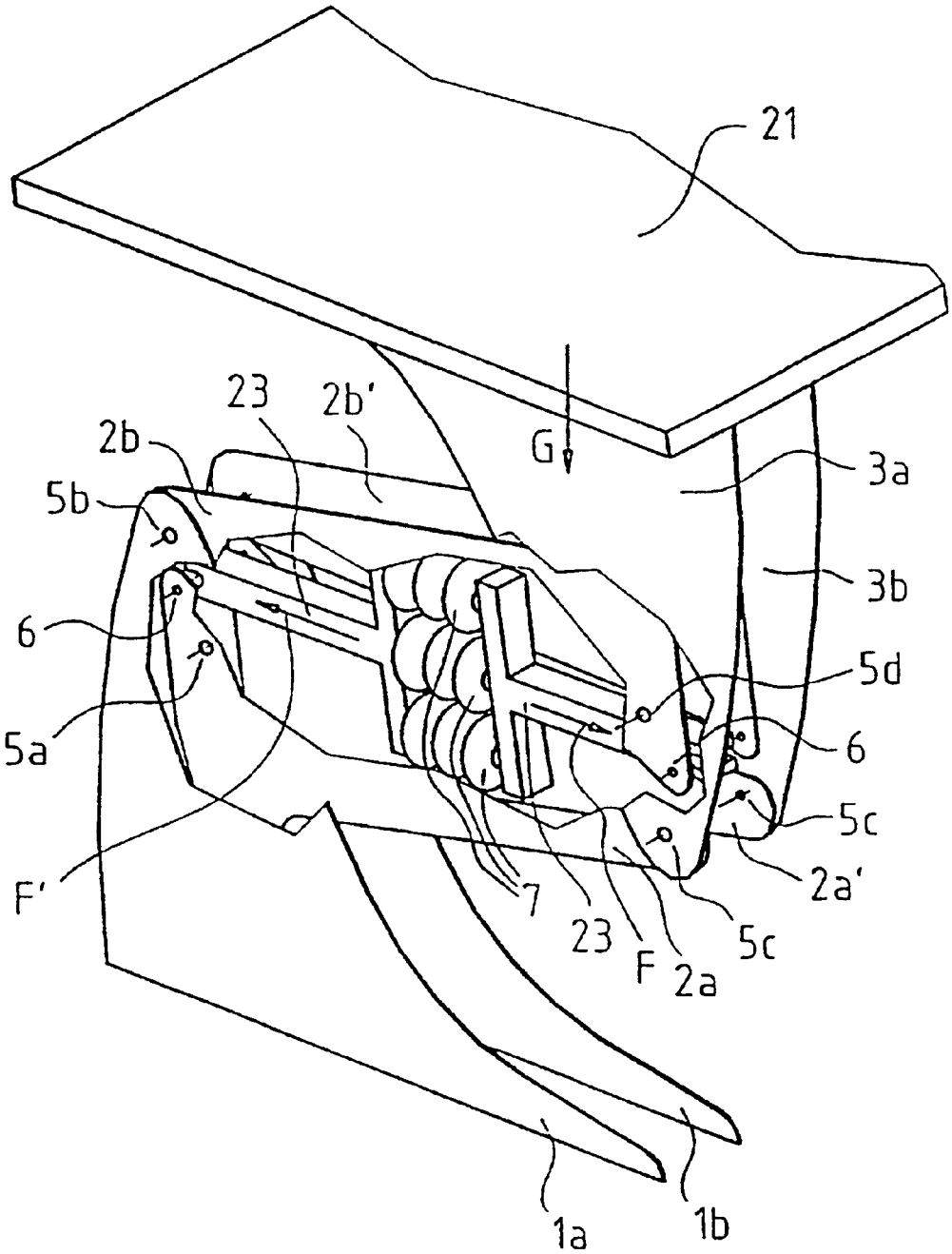
FIG. 2 shows a detail view of the base, support and counterweight element.

FIG. 2 shows a base 1 with a connecting means 2, a support 3 and a bellows cylinder 7 in detail. Three bellows cylinders 7 are arranged in parallel acting on the support 23, the entire lifting mechanism formed being designed in such a manner that the spring force F, F' is immediately used twice in order to produce a torque. As a result, the entire air spring formed by the bellows cylinders 7 can be half the size that it would be if it were supported directly on the lower, fixed base part 1*a*, 1*b*.

Figure 3A:
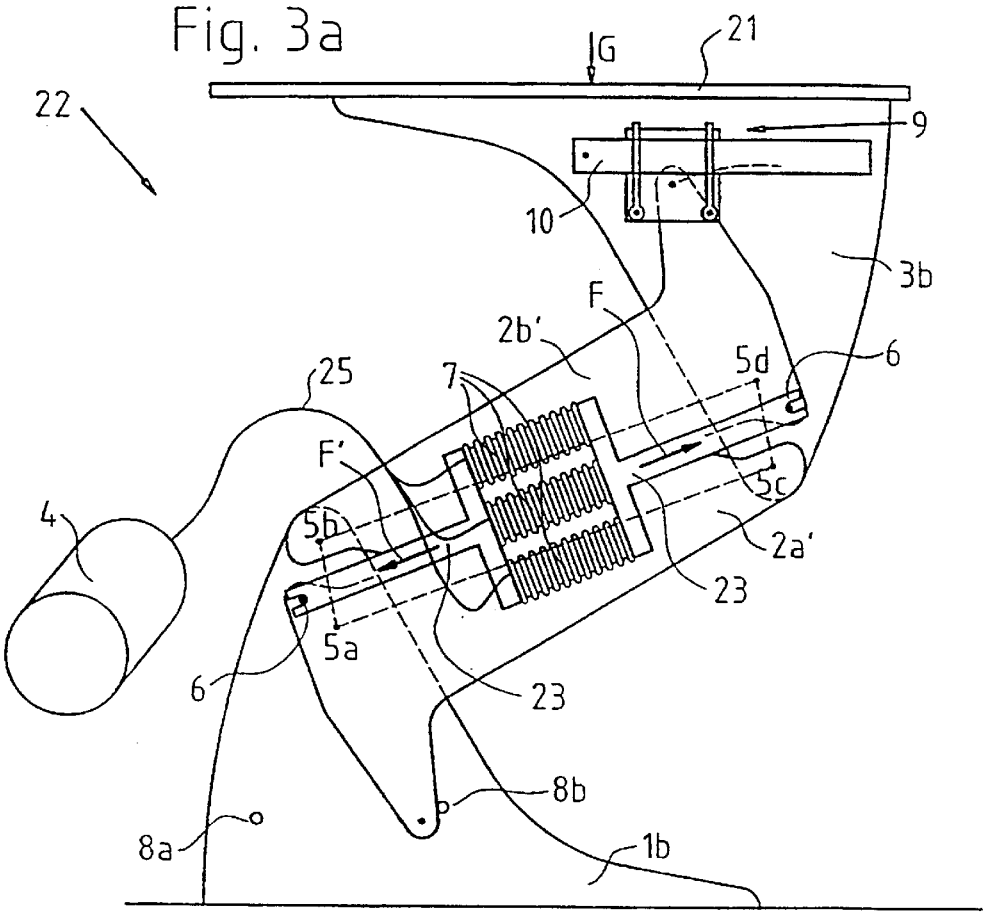
FIGS. 3*a*, 3*b* show a schematic side view of the base, support and counterweight element in a high and a low position respectively.
Figure 3B:
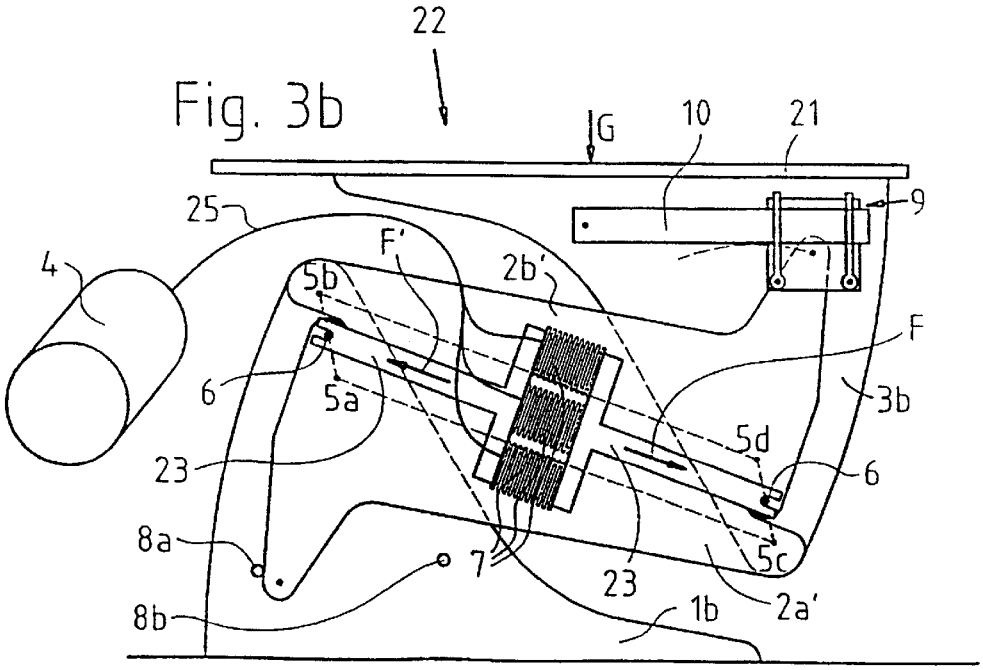

FIG. 3*a* and FIG. 3*b* show the table 22 together with the counterweight element 7 in a high position and a low position, the parallelogram formed by the articulated axles 5*a*, 5*b*, 5*c*, 5*d* being illustrated by dashed lines. The lifting mechanism illustrated, based on the parallelogram principle, consists of two articulated levers 2*a*, 2*b* which run parallel and are each designed as sub-levers 2*a*, 2*a*'; 2*b*, 2*b*' which are spaced apart in pairs in the longitudinal direction L, the articulated levers 2*a*, 2*b* forming a moveable connecting means 2 which connects the base 1 to the support 3. These upper and lower articulated levers 2*a*, 2*b* which are arranged in pairs are connected rotatably to the articulated axles 5*a*, 5*b*, 5*c*, 5*d*, which are also referred to as main axles. This parallelogram principle is not described in greater detail, since it is generally known. The pushing forces F, F' of the air spring formed as a bellows cylinder 7 act on the articulated levers 2*a*, 2*b* via the secondary bearings 6 connected fixedly to the articulated levers 2*a*, 2*b*. The articulated levers 2*a*, 2*b* are mounted rotatably, by means of their main bearings 5*a*, 5*b*, 5*c*, 5*d*, in the base 1 and in the support 3. Since the main bearings 5*a*, 5*b*, 5*c*, 5*d* and the secondary bearings 6 are offset by a distance with respect to one another, the spring forces F, F' cause, both on the lower and the upper articulated levers 2*a*, 2*b*, unidirectional, cumulative torques which are directed counter to the weight forces G. In practice, the pressure in the air springs formed as bellows cylinders 7 is set in such a manner that the torque from the spring force F and the torque from the weight force G cancel each other out. So that the spring force over the entire lifting or the entire adjustable lifting path of the table remains as constant as possible, an additional reservoir or pressure reservoir 4 is connected to the air springs 7 via the flexible connecting tubes 25. The flow cross section during the transition from the air spring 7 into the flexible connecting tube 25 is narrowed to such an extent that a restricting action is produced and too rapid a height adjustment of the table is effectively braked so as to prevent the sub-levers 2*a*, 2*a*' from colliding too rapidly with the limit stops 8*a*, 8*b*. The counterweight element 7 could also be arranged in the parallelogram in another manner known per se in order to generate from the pushing forces F, F', using the parallelogram principle, a force acting counter to the weight force G.

Figure 4:
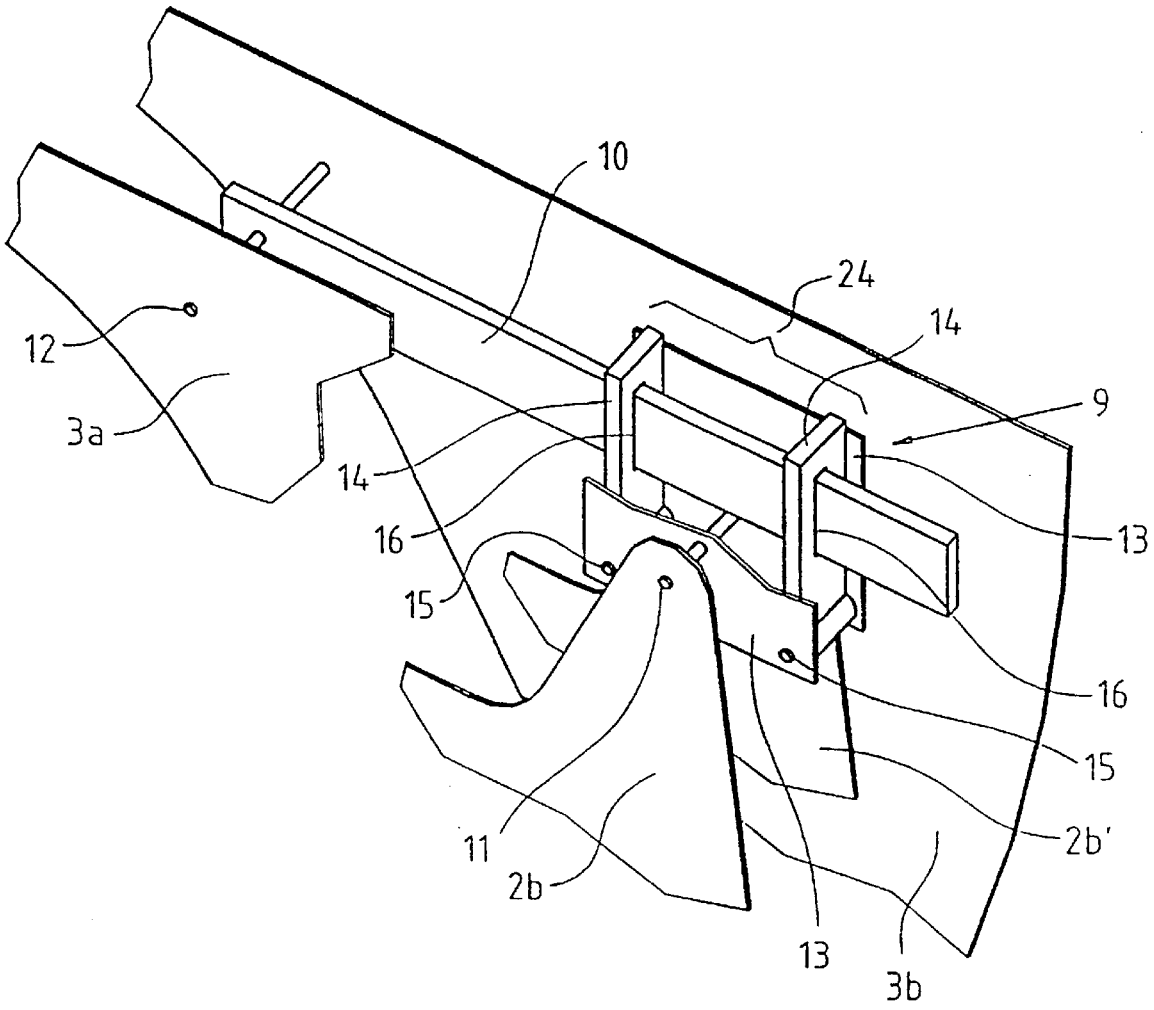
FIG. 4 shows a perspective view of an embodiment of a locking device.
Figure 5A:
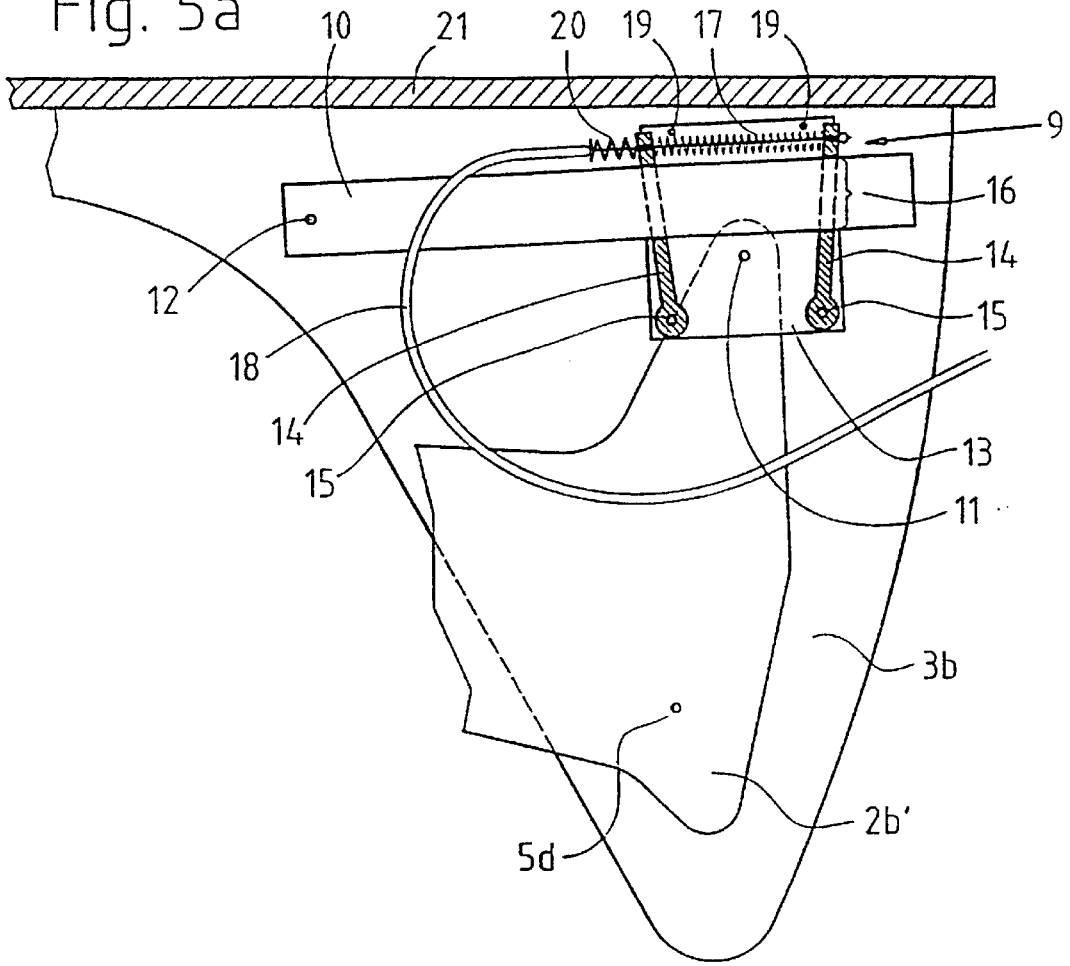
FIGS. 5*a*, 5*b* show the locking device according to FIG. 4 in a locked and a released position respectively.
Figure 5B:
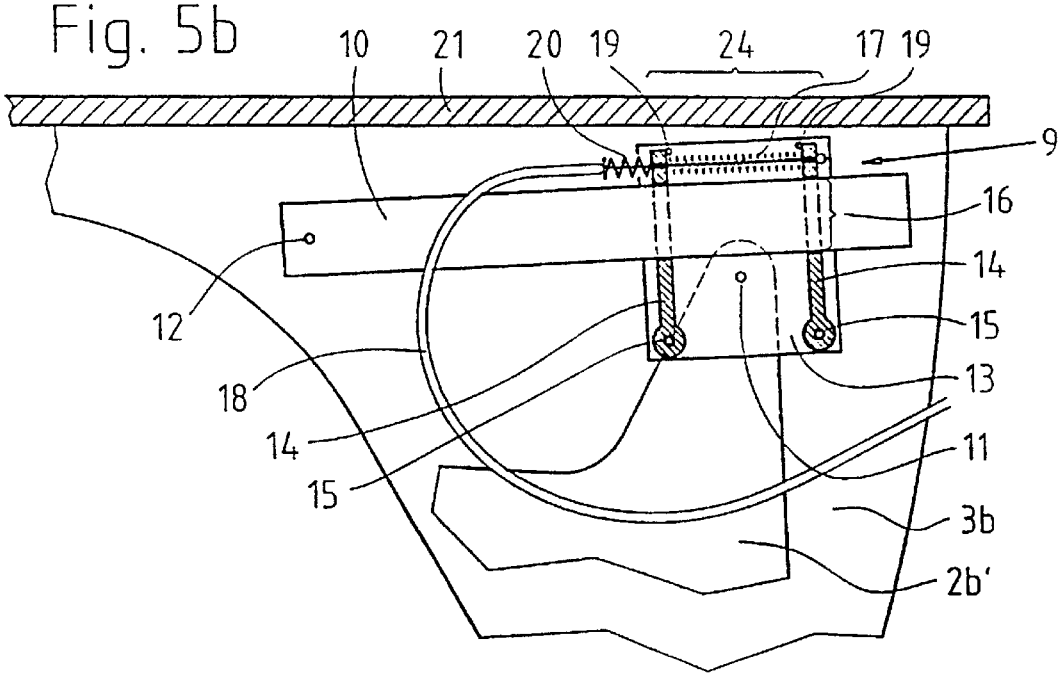

A locking device 9 is required in order to fix the table at the desired working height, an exemplary embodiment being illustrated in detail in FIGS. 4, 5*a* and 5*b*. A stopper subassembly 24 is connected in an articulated manner to the upper articulated lever 2*b*, 2*b*' via a bearing arrangement 11. During the height adjustment of the table, the stopper subassembly 24 slides along a rod 10 which, for its part, is connected in an articulated manner to the support 3; 3*a*, 3*b* via a bearing arrangement 12. The stopper subassembly 24 is designed in such a manner that sliding along the rod 10 is or is not possible, depending on the operating state. For this purpose, two clamping levers 14 are connected in an articulated manner via their bearing arrangements 15 to the housing 13 of the stopper subassembly 24. The rod 10 slides through holes 16 in the clamping levers 14. In this arrangement, the holes 16 are only a little larger than the cross section of the rod 10 and, moreover, are arranged sufficiently far away from the clamping-lever bearing arrangement 15 so that when a clamping lever 14 is tilted on the rod 10, a self-locking action is obtained, as is generally also known, for example from screw clamps. The two clamping levers 14 in turn are arranged sufficiently far away from each other so that in a position perpendicular to the rod 10, the entire stopper subassembly 24 is aligned with the position of the rod at that instance and therefore self-locking is prevented. The two operating states "slide" and "stop" are therefore possible.

If the table is in normal use, the clamping levers 14 are pressed away from one another by a stopper spring 17. The rod 10 becomes jammed in both directions, and the table can neither be moved up nor down and is therefore locked with regard to its position. An increase in the weight load supports the clamping action. If, however, the table is to be moved up or down, the clamping levers 14 have to be brought into a direction pointing perpendicular to the rod. For this purpose, use is made in this example of a Bowden cable 18 and a limit stop 19 for each clamping lever 14. The Bowden cable 18 is operated by a device which is not illustrated here and is preferably arranged below the table surface, for example as in the case of a bicycle brake lever. The device could, for example, also be designed as a separate lever situated on the floor and operable with the foot. As soon as the force on the Bowden cable is eased off, i.e. when the desired working height has been set, the stopper spring 17 brings the clamping levers 14 again into the "stop" position.

An additional safety spring 20 is installed between the cable end of the Bowden cable 18 and the clamping lever 14 as an intercepting brake. The safety spring 20 prevents the stopping mechanism from being able to be released if the weight load G is not sufficiently compensated for by the air spring 7. The safety spring 20 is dimensioned in such a manner that in this case it is not possible for a force of sufficient size to be transmitted to the clamping levers 14 in order to bring them into the perpendicular position, and the operation of the Bowden cable 18 remains ineffective.

A force is brought about on the axle 12 by the rod 10 if the stopper subassembly 24 is in the operating state "stop" and the weight force G is not compensated for by the counterweight element 7. Only in the position of equilibrium is no pushing force brought about on the axle 12 by the rod 10. An indicating device could therefore be provided which indicates this force in order to bring the table 22 into an exact position of equilibrium. This indicating device is particularly advantageous when supplying air to or letting air out of the reservoir, so that because of the indication air is supplied or removed in a simple manner to such an extent that the table 22 with the loads situated on it is in the position of equilibrium. This force-absorbing and indicating device may, for example, be designed mechanically by the axle 12 being connected to the rod 10 and being connected to the support 3*a*, 3*b* via a spring, it being possible to indicate the position of equilibrium with the aid of the deflection of the spring.

The two supports 3 which are arranged spaced apart in the longitudinal direction L and the articulated lever 2*a* or 2*b* can be connected fixedly to one another via a torsion bar or torsional stiffener running in the longitudinal direction L, in order in particular to give the entire table 22 improved stability. This torsion bar could likewise be designed as the cylindrical reservoir 4. The torsion bar advantageously runs through the articulated axles 5*a*, 5*b*, 5*c*, 5*d*.

In the exemplary embodiment according to the FIGS. 1*a*, 1*b*, 2, 3*a*, 3*b* the base 1 and the support 3 are held in a mutually symmetrical position by means of the connecting means 2. In this arrangement, the base 1 and the support 3 together with the connecting means 2 form an S shape.

A suitable fluid for operating the counterweight element 7 is air in particular, but other gaseous media are also suitable.

The counterweight elements 7 are illustrated in each case running in a parallel arrangement next to one another. However, the counterweight elements 7 could also be installed individually, or could be arranged in a series arrangement one behind another or in a combination of both in series and parallel to one another.

The locking device 9 could, for example, also be designed as a disc brake or a shoe brake.

Figure 7:
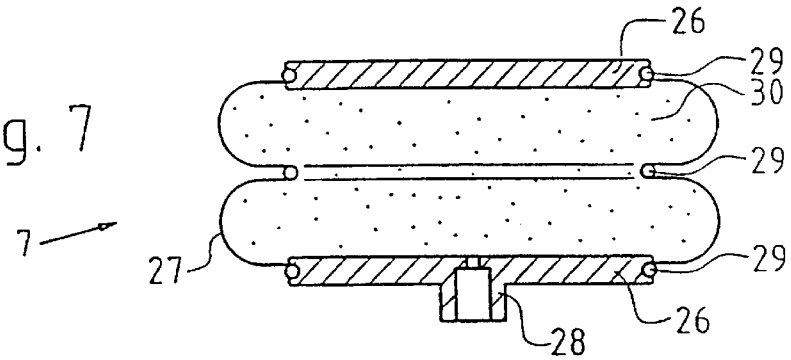
FIG. 7 shows an embodiment of a bellows cylinder.

FIG. 7 shows an exemplary embodiment of a bellows cylinder 7, also called "bellows type spring", having an interior 30 which is bounded at one end by a flexible covering 27 and at the other end by two end plates 26. The flexible covering 27, made, for example, of rubber, is connected fixedly to the end plate 26 by a bracing ring 29. A further bracing ring 29 is arranged in the middle of the flexible covering 27 in order to stabilize the position of the flexible covering 27. The bellows cylinder 7 has a connection 28 for a gaseous fluid, this connection 28 being of constricted design in order at the same time to form a restriction for the fluid. The gaseous fluid, in particular air, is supplied to the interior 30 or removed therefrom via the connection 28. As the pressure of the fluid in the interior 30 rises, the bellows cylinder in the illustrated arrangement undergoes an extension in the vertical direction and as the pressure falls, undergoes compression in the vertical direction.

Figure 8:
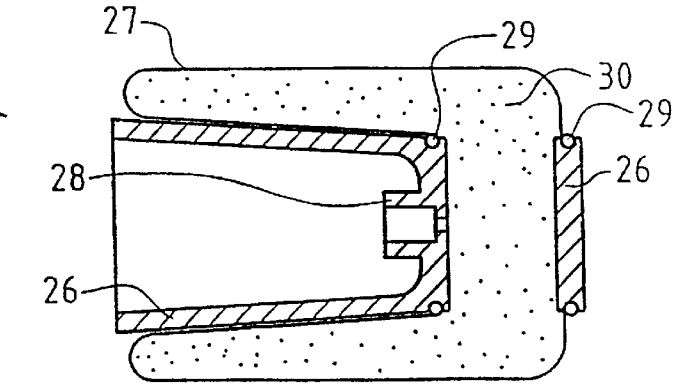
FIG. 8 shows an embodiment of a U-type bellows cylinder.

FIG. 8 shows an exemplary embodiment of a U-type bellows cylinder 7, also called a "rolling lobe spring", having an interior 30 which is bounded at one end by the flexible covering 27 and at the other end by the parts 26. The flexible covering 27 consists of an elastic, pressure-resistant material. The flexible covering 27 is connected fixedly to the parts 26 by a respective bracing ring 29. The U-type bellows cylinder 7 likewise has a connection 28, which forms a restriction, for supplying and removing a gaseous fluid. In the illustrated arrangement, the distance between the two parts 26 increases in the horizontal direction if the pressure of the fluid in the interior 30 is increased, in which case that subsection of the covering 27 which rests on the part 26 illustrated on the left is partially unwound. All of the exemplary embodiments illustrated in the present patent could have a U-type bellows cylinder or a tubular cylinder instead of a bellows cylinder.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

What is claimed is:

1. A height-adjustable tale, comprising: a tabletop; a base; a support for holding the tabletop; moveable connecting means for supporting the support in a height-adjustable manner with respect to the base; a pneumatic, pressure-actuable counterweight element which is operatively arranged between the base and the support so that a reaction force can be generated acting counter to a gravitational force acting on the support; and a reservoir, the counterweight element being connected in a fluid-conducting manner to the reservoir which is arranged spaced apart so as to form, together with the reservoir, a closed volume containing a fluid, the counterweight element having a maximum volume, the reservoir having a volume that corresponds at least to twice the maximum volume of the counterweight element.

2. A height-adjustable table as defined in claim 1, wherein the counterweight element is one of a cylinder having a displaceable piston, a balloon, a tubular cylinder, a U-type bellows cylinder, a bellows cylinder and a gas-filled compression spring.

3. A height-adjustable table as defined in claim 1, wherein a plurality of counterweight elements are arranged at least one of parallel and in series to one another.

4. A height-adjustable table as defined in claim 1, and further comprising means for connecting the counterweight element and the reservoir in a fluid-conducting manner that produces a restricting effect.

5. A height-adjustable table as defined in claim 1, wherein the moveable connecting means includes one of a parallelogram guide, a scissors-type guide and a linear guide.

6. A height-adjustable table as defined in claim 1, wherein the connecting means is a parallelogram linkage of levers including two parallel articulated levers which run at a distance above one another and are coupled at a first end to the base and at a second end to the support so that the levers can pivot around parallel articulated axles, the counterweight element being coupled to the articulated levers so as to be held one of extensibly and compressibly in a longitudinal direction of the articulated levers.

7. A height-adjustable table as defined in claim 6, wherein each articulated lever consists of two sub-levers which are mutually spaced apart in a longitudinal direction of the table so that there is space for the counterweight element between the sub-levers.

8. A height-adjustable table as defined in claim 7, wherein the base and the support are designed in two parts and are arranged spaced apart in the longitudinal direction of the table.

9. A height-adjustable table as defined in claim 1, comprising two said bases arranged spaced apart in a longitudinal direction of the table, two supports, two connecting means and two counterweight elements, the two counterweight elements being connected in a fluid-conducting manner to a common reservoir.

10. A height-adjustable table as defined in claim 9, wherein the common reservoir is connected fixedly to the two bases which are spaced apart in an axial direction.

11. A height-adjustable table as defined in claim 9, wherein the two connecting means are spaced apart in the longitudinal direction and are connected fixedly to each other by a torsion-proof connection.

12. A height-adjustable table as defined in claim 11, wherein the torsion-proof connection includes a torsion rod arranged to run through articulated axles of the two connecting means.

13. A height-adjustable table as defined in claim 1, and further comprising locking means for locking the moveable connecting means in a set height position.

* * * * *